United States Patent [19]

Kitamura et al.

[11] Patent Number: 4,903,369

[45] Date of Patent: Feb. 27, 1990

[54] SUCTION NOZZLE DEVICE FOR USE IN VACUUM CLEANER

[75] Inventors: Hidenori Kitamura; Yoshitaka Murata, both of Shiga, Japan

[73] Assignee: Matsushita Electric Industrial Co., Ltd., Osaka, Japan

[21] Appl. No.: 228,090

[22] Filed: Aug. 4, 1988

[30] Foreign Application Priority Data

| | | | |
|---|---|---|---|
| Aug. 6, 1987 | [JP] | Japan | 62-196710 |
| Aug. 11, 1987 | [JP] | Japan | 62-122615[U] |
| Nov. 18, 1987 | [JP] | Japan | 62-175895[U] |

[51] Int. Cl.[4] ..... A47L 9/04

[52] U.S. Cl. ..... 15/384; 15/388; 15/392; 15/402; 15/415 R

[58] Field of Search ..... 15/383, 384, 388, 366, 15/402, 415 R, 418–422, 392

[56] References Cited

U.S. PATENT DOCUMENTS

| | | | |
|---|---|---|---|
| 1,291,802 | 1/1919 | Drake | 15/388 X |
| 1,907,642 | 5/1933 | DeMaree | 15/383 X |
| 1,919,067 | 7/1933 | Lang et al. | 15/383 |
| 1,957,506 | 5/1934 | Smellie | 15/366 |
| 2,227,649 | 1/1941 | Hutchinson . | |
| 2,665,979 | 2/1954 | MacFarland | 15/392 X |
| 3,753,268 | 8/1973 | Bayless | 15/384 |
| 4,403,372 | 9/1983 | Keane et al. . | |

FOREIGN PATENT DOCUMENTS

| | | | |
|---|---|---|---|
| 223232 | 1/1959 | Australia . | |
| 526867 | 3/1980 | Australia . | |
| 1903416 | 8/1970 | Fed. Rep. of Germany | 15/384 |
| 2921874 | 12/1979 | Fed. Rep. of Germany . | |

*Primary Examiner*—Chris K. Moore

*Attorney, Agent, or Firm*—Pollock, VandeSande & Priddy

[57] ABSTRACT

A suction nozzle device connected to a vacuum cleaner for cleaning beddings such as blankets. The suction nozzle device includes a nozzle which is coupled through a suction passage to an electric blower of the vacuum cleaner and which has a suction opening at its end portion which is arranged so as to face an object to be cleaned. Also included is a pair of rotatable rollers each of which is cylindrically shaped and has on its outer circumferential surface a plurality of tooth-portions which are radially protruded from said outer circumferential surface. The suction opening thereof is positioned to be interposed between the pair of rotatable rollers. Each of the tooth-portions is elongated by a predetermined length in the directions of the axes of the rotatable rollers. Each of the rotatable rollers is divided into a plurality of sections each of which has a predetermined number of the tooth-portions and is formed so as to have at least a flat portion between the tooth-portions. The adjacent ones of the plurality of sections are disposed so that their flat portions are in 180° out-of-phase relation to each other.

11 Claims, 5 Drawing Sheets

SUCTION NOZZLE DEVICE FOR USE IN VACUUM CLEANER

BACKGROUND OF THE INVENTION

The present invention relates generally to vacuum cleaners, and more particularly to improvement of a suction nozzle device of such a vacuum cleaner for appropriately cleaning beddings such as a blanket.

Generally, vacuum cleaners include as an attachment a suction nozzle device which is used properly and detachably in accordance with an object to be cleaned, for the cleaning purpose, the suction nozzle device being coupled through a suction passage to the suction side of an electric blower located in a housing of the vacuum cleaner. One device of the type as is known in the art for cleaning beddings is so constructed that as shown in FIG. 1A a nozzle body 1 has a connection pipe 2 which is detachably coupled to the suction passage and a rotatable roller 3 is disposed in the nozzle body 1 so as to be rotatable about the longitudinal axis of the nozzle body 1. The rotatable roller 3 has on its circumferential surface a number of protruding portions, i.e., bosses, which are radially arranged at a predetermined angular interval in its cross-section as shown in FIG. 1B. The thus constructed device has a disadvantage that when used for a bedding with a lace-made cover, for example, the rotation of the rotatable roller 3 tends to become difficult because the bosses are cut into the stitches of the cover and the compulsory use results in the cover being damaged. In addition, the manufacturing of such a rotatable roller 3 is not easy because of its dependence upon only the resin injection formation and hence becomes costly.

SUMMARY OF THE INVENTION

It is therefore an object of the present invention to provide a suction nozzle device for vacuum cleaners which is capable of being manufactured at a relatively low cost and surely and easily cleaning such a bedding.

With this and other objects which will be become apparent as the description proceeds, a suction nozzle device for use in a vacuum cleaner according to the present invention comprises a housing: nozzle means disposed in the housing and coupled through a section passage to an electric blower of the vacuum cleaner, the nozzle means having a suction opening at its end portion which is arranged so as to face an object to be cleaned; and rotatable roller means disposed in the housing and cylindrically shaped and having on its outer circumferential surface a plurality of tooth-portions which are radially protruded from the outer circumferential surface and each of which is elongated by a predetermined length in directions of the axis of the rotatable roller means. More specifically, the rotatable roller is divided into a plurality of sections each of which has a predetermined number of the tooth-portions and is formed so as to have at least one flat portion between the tooth-portions, the adjacent ones of the plurality of sections being disposed so that their flat portions are in 180° out-of-phase relation to each other.

Preferably, the rotatable roller means comprises two rotatable rollers which are positioned so that the suction opening of the nozzle means is interposed therebetween, and the nozzle means is tapered down in the forward and backward directions of the suction nozzle device so that the area of its cross-section is decreased toward the suction opening. Further preferably, the suction opening of the nozzle means is positioned upwardly a predetermined distance from a contact point of the rotatable roller means with said object, and the suction opening has a substantially rectangular configuration and the dimension of the suction opening is 180 to 300 millimeters in length and 4 to 10 millimeters in width. Still further preferably, the suction opening is divided into a plurality of opening sections by means of a plurality of ribs, and the rotatable rollers are rotatably supported by a pair of plates which are in turn supported pivotally by the housing.

BRIEF DESCRIPTION OF THE DRAWINGS

The present invention will be described in further detail with reference to the accompanying drawings, in which.

DETAILED DESCRIPTION OF THE INVENTION

Figure 1A:
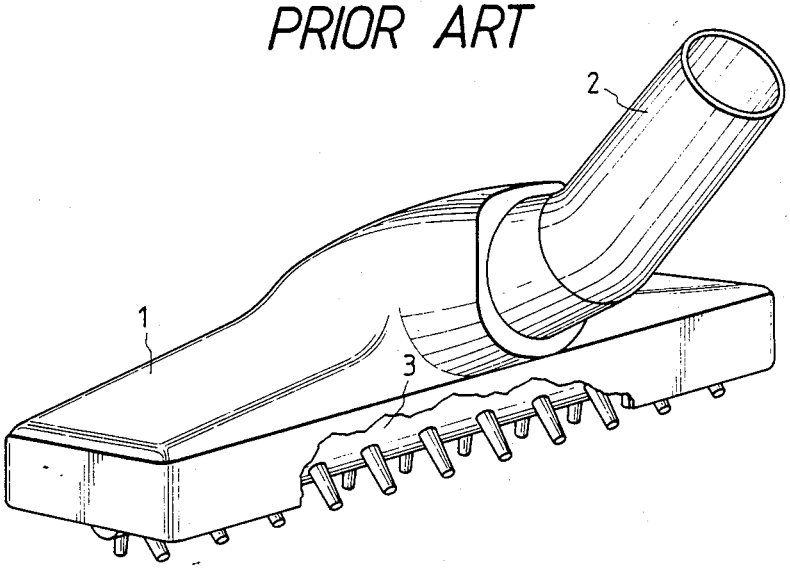
FIG. 1A PRIOR ART
Figs. 1A and 1B are illustrations for describing one conventional suction nozzle device of a vacuum cleaner.
Figure 1B:
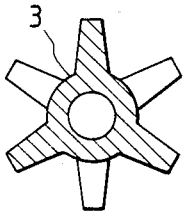
FIG. 1B PRIOR ART
Figure 2:
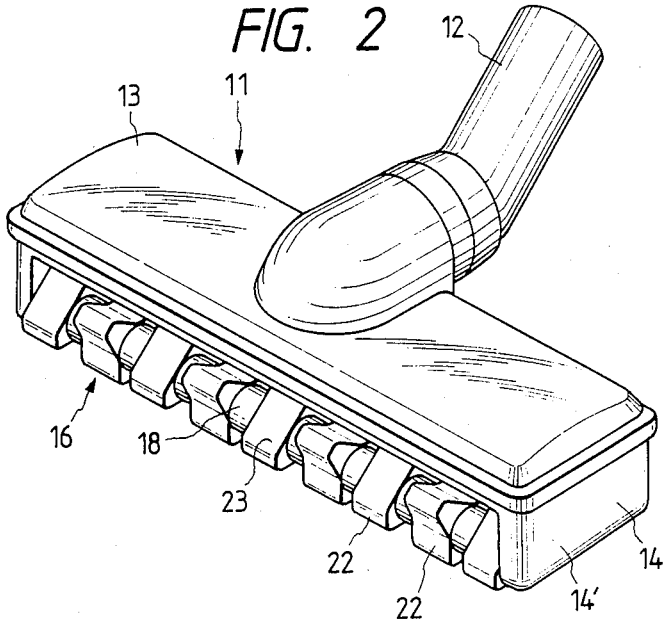
FIG. 2 is a perspective view showing a suction device according to an embodiment of the present invention.
Figure 3:
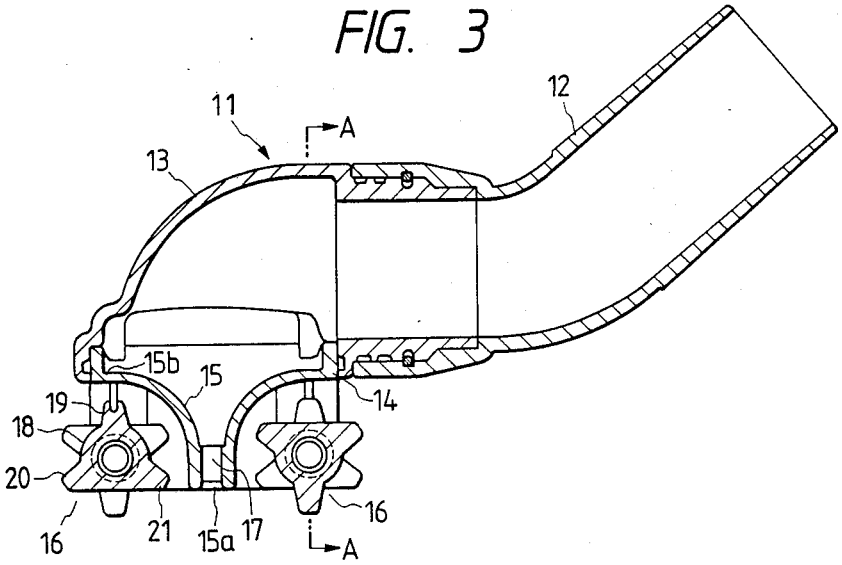
FIG. 3 is a cross-sectional view of the FIG. 2 suction nozzle device.

Referring now to FIG. 2, there is illustrated a suction nozzle device according to an embodiment of the present invention which is suitable for cleaning beddings such as a blanket. In FIG. 2, the suction nozzle device includes a nozzle body, or housing, 11 shaped to have an elongated box-like configuration, the nozzle body 11 comprising an upper cover portion 13 to which a connection pipe 12 is coupled so as to be rotatable with respect to the upper cover portion 13 and a lower case portion 14 for accommodating therein a pair of rotatable rollers 16 which are rotatably supported on side surfaces 14' of the lower case portions 14 so as to extend parallel to each other in the longitudinal directions of the nozzle body 11. The front and rear sides of the lower case portion are opened so that the pair of rotatable rollers 16 appear. As illustrated in FIG. 3 showing the cross-sectional view of the suction nozzle device, between the pair of rotatable rollers 16 is provided a nozzle portion 15 tapered down laterally, i.e., in the transverse directions of the nozzle body 11, so as to form a slit-like suction opening **15*a* at its lower end portion, the longitudinal axis of the slit-like suction opening 15*a* being substantially parallel to the rotational axes of the pair of rotatable rollers 16. The upper end portion 15*b* of the tapered nozzle portion 15 is connected to the upper cover portion 13 so that the nozzle portion 15 is coupled through the inside of the upper cover portion 13 to the connection pipe 12. Here, the tapered nozzle portion 15 is arranged so as to be spaced from the pair of rotatable rollers 16 by a predetermined distance (for example, several millimeters) and the suction opening 15***a* is positioned upwardly by a predetermined height (for example, about 5 millimeters) from an object to be cleaned when the suction nozzle device is set to the cleaning state, that is, when the pair of rotatable rollers 16 is brought into contact with the object. Furthermore, the width of the suction opening 15*a* (in the moving direction of the suction nozzle device) may be set to 4 to 10 millimeters, preferably 6 millimeters and the length thereof may be set to 180 to 300 millimeters, preferably 180 millimeters. The suction opening 15*a* is divided by means of ribs 17 into a plurality of sections.

Figure 4:
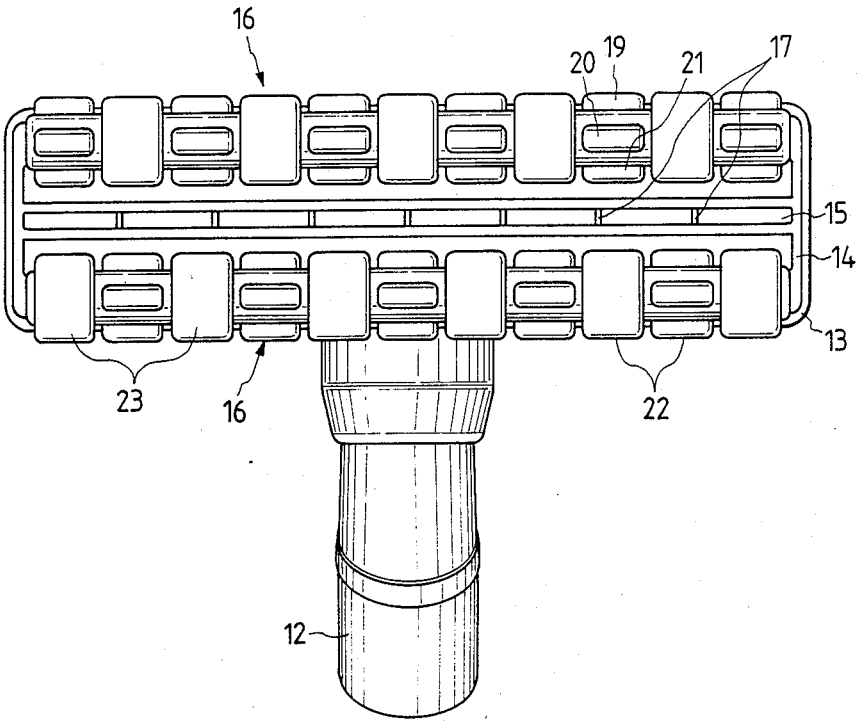
FIG. 4 is a bottom view of the FIG. 2 suction nozzle device.
Figure 5:
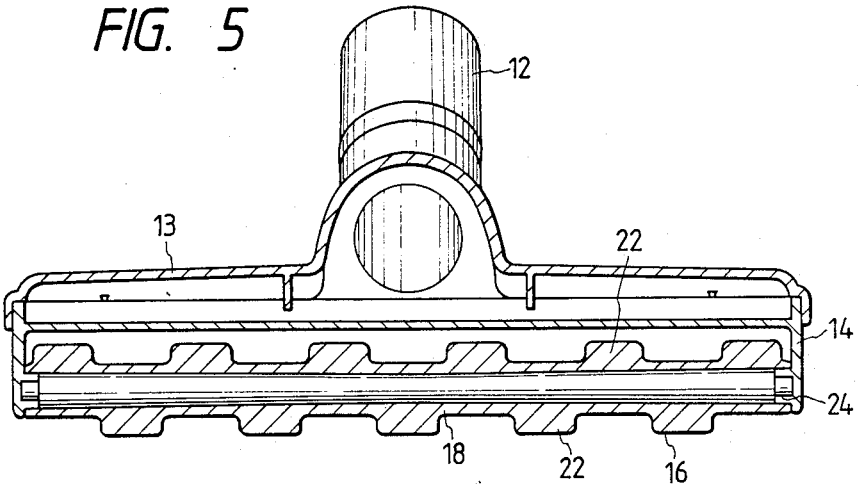
FIG. 5 is a cross-sectional view taken along line A—A of FIG. 3.
Figure 6:
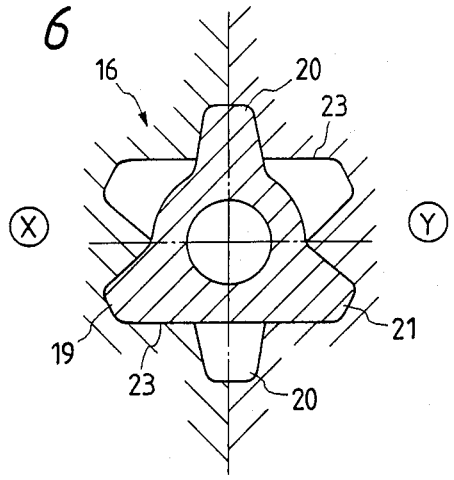
FIG. 6 is a cross-sectional view of a rotatable roller of the FIG. 2 suction nozzle device.

As seen from FIGS. 4 and 5 which are a bottom view of the suction nozzle device and a cross-sectional view taken along line A–A of FIG. 3, each of the rotatable rollers 16, supported to the lower case portion 14 through shafts 24, comprises a substantially cylindrical base portion 18 which is in turn divided into a plurality of sections 22, each of which has on its outer circumferential surface elongated tooth-portions 19, 20 and 21 which are radially protruded therefrom by a predetermined height (for example, about 5 millimeters) so as to be in angle-equal relation to each other, i.e., at an angular interval of 120°, each of the tooth-portions 19, 20, 21 having a length of about 20 millimeters in the directions of the axes of the rotatable rollers 16. Here, the adjacent sections 22 of each of the rotatable rollers 16 are disposed so as to have a phase difference of 180°. As will be better understood from FIG. 6 showing a cross-sectional view of each of the rotatable rollers 16, each of the sections 22 has one flat portion 23 between at least the tooth-portions 19 and 21 whose center line is substantially coincident in direction with the center line of the tooth-portion 20 of the adjacent section 22. This arrangement allows the rotatable rollers 16 to be easily manufactured at a low cost because each of the rotatable rollers 16 can be injection formed using two metal patterns corresponding to the two parts illustrated by X and Y in FIG. 6.

With the above-mentioned arrangement, in response to movement of the suction nozzle device along the surface of an object to be cleaned, the pair of rotatable rollers 16 rotates so as to allow the tooth-portions 19, 20, 21 to tap dust therefrom. Since each of the tooth-portions 19, 20 and 21 has a length of about 20 millimeters, the tooth-portions 19, 20 and 21 cannot be inserted into the stitches of the lace-made cover, thereby ensuring smooth and sure rotation of the rotatable rollers 16. Furthermore, the wide width of the tooth-portions 19, 20 and 21 causes an increase of the tapping force against the bedding by about four times, resulting in an improvement of the dust-suction performance. As further effects by the above-mentioned arrangement, since the suction opening 15*a* is positioned to be slightly above (about 5 millimeters) the surface of the bedding to be cleaned, a portion of the bedding between the pair of rotatable rollers 16 is lifted up thereto and dust inside the bedding can be further sucked in response to operation of the vacuum cleaner. Here, since the width of the suction opening 15*a* is relatively small (about 6 millimeters), the suction force does not affect the movement of the suction nozzle device.

Figure 7:
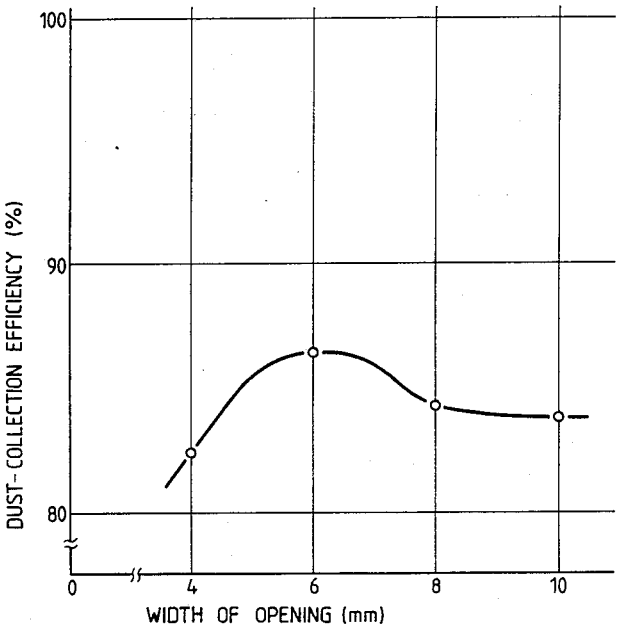
FIG. 7 is a graphic illustration for describing the relation between the dust-collecting efficiency and the width of the suction opening of vacuum nozzles.

FIG. 7 shows the relation between the dust collecting efficiency and the width of the suction opening which is obtained by an experiment. As will be understood from FIG. 7, when the width of the suction opening is between 4 and 10 mm, the dust-collecting efficiency is relatively high. The wide width of the suction opening results in lack of smoothness of movement of the suction nozzle device due to a large suction force. The relatively long length of the suction opening results in a wide cleaning width, i.e., shortening the cleaning time, but similarly results in failing to smoothly move the suction nozzle device. According to an experiment, it is better to set the length of the suction opening to 180 to 300 mm.

Furthermore, as described above, since the suction opening 15*a* is divided into a plurality of sections by means of the ribs 17 which are positioned upwardly from the end of the suction opening by about 2 millimeters, the inserting amount of the surface of the bedding into the suction opening is limited and therefore the rapid movement of the suction nozzle device does not cause the bedding to be damaged. In addition, since the nozzle portion 15 is tapered in the forward and backward directions of the suction nozzle device and the upper portion thereof is wider, it is possible to obtain noise control effect. On the other hand, since the nozzle portion 15 is not tapered in the longitudinal direction of the suction nozzle device, it is possible to provide a uniform suction force as a whole. Furthermore, the opening of the front and rear sides of the lower case portion 14 allows prevention of intrusion of the bedding between the lower case portion 14 and the rotatable rollers 16.

Figure 8:
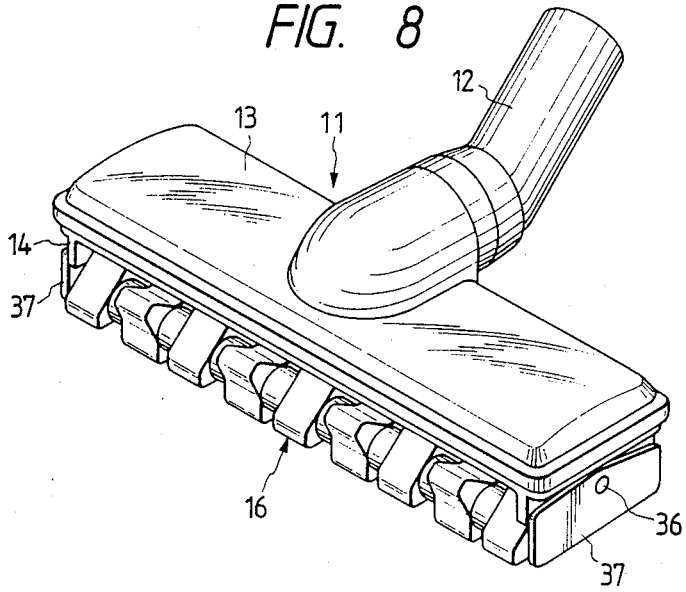
FIG. 8 is a perspective view showing a suction nozzle device according to another embodiment of the present invention.
Figure 9:
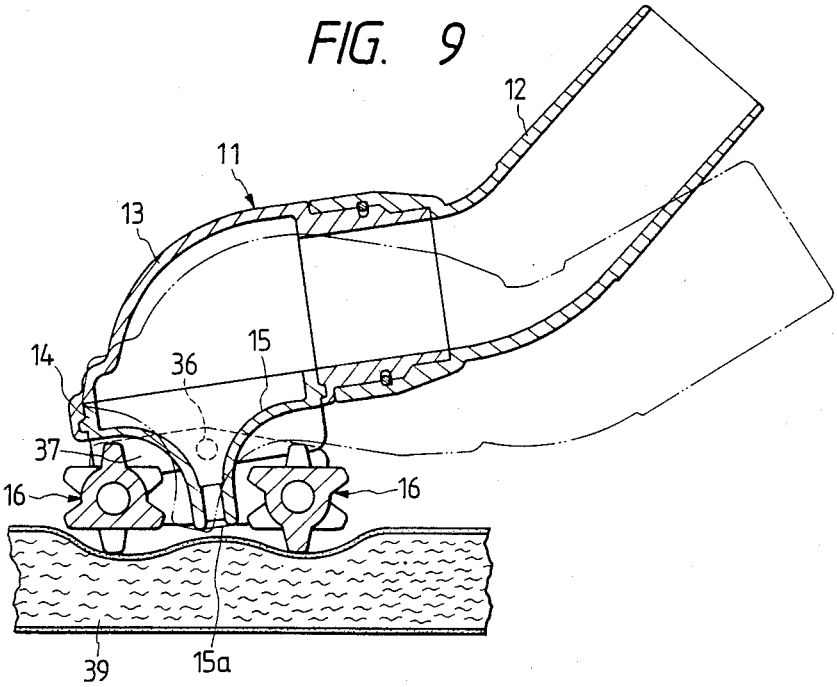
FIG. 9 is a cross-sectional view of the FIG. 8 suction nozzle device.

FIGS. 8 and 9 are illustrations of another embodiment of the present invention in which parts corresponding to those in the drawings showing the first embodiment are marked with the same numerals and the description will be omitted for brevity. One feature of this embodiment is that a pair of swingable plated 37 is provided so as to be pivotally supported by one end of supporting pins 36, the other end of which are fixedly secured to upper portions of both sides of a lower case portion 14 of a nozzle body 11, so that the pair of swingable plates 37 is swingable or rotatable about the supporting pins 36. A pair of rotatable rollers 16 is rotatably supported by the swingable plates 37 so that they are swingable with the swingable plates 37 with respect to a nozzle portion 15. With this arrangement, even if during the cleaning operation the nozzle body 11 is moved swingingly, i.e., forwardly and backwardly, through a connection pipe 12, both the rotatable rollers 16 can be kept stably to be brought into contact with the surface of a bedding 39. The stable contact f both the rotatable rollers 16 with the bedding 39 can result in ensuring a stable dust-collecting performance of the vacuum cleaner.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention.

What is claimed is:

1. A suction device for use in a vacuum cleaner comprising:

a housing;

a nozzle disposed in said housing and coupled through a suction passage to an electric blower of said vacuum cleaner, said nozzle means having a suction opening at its end portion which is arranged so as to face an object to be cleaned; and at least one pair of rotatable rollers which are disposed in said housing and each of which is cylindrically shaped and has on its outer circumferential surface a plurality of tooth-portions which radially protrude from said outer circumferential surface and each of which is elongated by a predetermined length in the direction of the rotational axis of said rotatable rollers, each of said pair of rotatable rollers being rotatable forwardly or backwardly in accordance with movement of said suction nozzle device and said tooth-portions being arranged to be successively brought into contact with said object so as to tap a surface of said object in response to the rotations of said pair of rotatable rollers.

2. A suction nozzle device as claimed in claim 1, wherein each of said pair of rotatable rollers is divided into a plurality of sections each of which has a predetermined number of said tooth-portions and is formed so as to have flat portions between said tooth-portions, the adjacent ones of said plurality of sections being disposed so that their flat portions are in 180° out-of-phase relation to each other.

3. A suction nozzle device as claimed in claim 1, wherein said pair of rotatable rollers are positioned so that said suction opening of said nozzle is interposed therebetween.

4. A suction nozzle device as claimed in claim 1, wherein said nozzle is tapered down in the forward and backward directions of said suction nozzle device so that the area of its cross-section is decreased toward said suction opening.

5. A suction nozzle device as claimed in claim 1, wherein said suction opening of said nozzle is positioned upwardly by a predetermined distance from a contact point of said rotatable rollers with said object.

6. A suction nozzle device as claimed in claim 1, wherein said suction opening has a substantially rectangular configuration and the dimension of said suction opening is 180 to 300 millimeters in length and 4 to 10 millimeters in width.

7. A suction nozzle device as claimed in claim 1, wherein the front and rear sides of said housing have openings so that said rotatable rollers are exposed.

8. A suction nozzle device as claimed in claim 1, wherein said suction opening is divided into a plurality of sections by means of a plurality of ribs disposed in said nozzle.

9. A suction nozzle device as claimed in claim 1, wherein said rotatable rollers are rotatably supported by a pair of plates which are in turn supported pivotally by said housing.

10. A suction nozzle device for use in a vacuum cleaner comprising:

a housing;

a pair of rotatable rollers disposed in said housing; and at least one nozzle disposed in said housing and coupled through a suction passage to an electric blower of said vacuum cleaner, said nozzle having a suction opening at its end portion which is arranged so as to face an object to be cleaned and said suction opening thereof being positioned between said pair of rotatable rollers, said nozzle being tapered down in the forward and backward directions of said suction nozzle device so that the area of its cross-section is decreased toward said suction opening.

11. A suction nozzle device for use in a vacuum cleaner comprising:

a housing;

nozzle means disposed in said housing and coupled through a suction passage to an electric blower of said vacuum cleaner, said nozzle means having a suction opening at its end portion which is arranged so as to face an object to be cleaned; and at least a pair of rotatable rollers disposed in said housing on first and second sides of said nozzle means and rotatably supported by a pair of plates which are pivotally supported by said housing.

* * * * *